United States Patent [19]

Davenport et al.

[11] Patent Number: 4,968,916

[45] Date of Patent: Nov. 6, 1990

[54] XENON-METAL HALIDE LAMP PARTICULARLY SUITED FOR AUTOMOTIVE APPLICATIONS HAVING AN IMPROVED ELECTRODE STRUCTURE

[75] Inventors: John M. Davenport, Lyndhurst; Rocco T. Giordano, Garfield Heights; Richard L. Hansler, Pepper Pike; Robert H. Springer, Solon, all of Ohio

[73] Assignee: General Electric Company, Schenectady, N.Y.

[21] Appl. No.: 404,805

[22] Filed: Sep. 8, 1989

[51] Int. Cl.[5] ..... H01J 17/20; H01J 17/04; H01J 61/073; H01J 61/40

[52] U.S. Cl. ..... 313/571; 313/631; 313/285; 313/113

[58] Field of Search ..... 313/571, 631, 632, 285, 313/288, 113

[56] References Cited

U.S. PATENT DOCUMENTS 2,518,944 8/1950 Scott ..... 313/285 X
3,706,900 12/1972 Van Beek ..... 313/285 X
4,254,356 3/1981 Karikas ..... 313/217
4,574,219 3/1986 Davenport et al. ..... 315/49

*Primary Examiner*—Sandra L. O'Shea
*Attorney, Agent, or Firm*—John P. McMahon; Stanley C. Corwin; Fred Jacob

[57] ABSTRACT

A xenon metal halide lamp having an improved electrode structure that is particularly suited for automotive applications is disclosed. The electrode is comprises of a tip portion that is located at one end of a shank with the shank having a filament coiled therearound. The tip and shank portions are designed to allow for high initial current during starting and low current during operation. The coil filament is situated in opposite neck portions of an envelope forming the light source so as to; (1) cause the electrodes to be axially aligned within the light source; (2) keep the shank of the electrode from intimate contact with the envelope thereby preventing the condensation of the mercury and allowing for substantial vaporization of the metal halide ingredients at the neck portion; and (3) prevent the thermal expansion of the electrode from cracking the envelope.

7 Claims, 2 Drawing Sheets

XENON-METAL HALIDE LAMP PARTICULARLY SUITED FOR AUTOMOTIVE APPLICATIONS HAVING AN IMPROVED ELECTRODE STRUCTURE

CROSS REFERENCE TO RELATED APPLICATION

U.S. patent application Ser. Nos. 413,815 and 413,816 filed herewith and assigned to the same assignee as the present invention are all related to the present invention.

BACKGROUND OF THE INVENTION

The present invention relates to a xenon-metal halide lamp having an improved electrode structure which is particularly suited for forward lighting applications of a vehicle such as an automobile, truck, bus, van or tractor. More particularly, the improved electrode structure comprises a shank having a coil wrapped about it for accurately aligning the electrodes to the axis of the lamp. The improved electrode has parameters that are selected to accommodate the various electrical current conditions which occur during the operation of the xenon-metal halide lamp.

A xenon-metal halide lamp serving well as a light source for an automotive headlamp is disclosed in U.S. patent application Ser. No. 157,436 of Bergman et al. filed 02/18/88 assigned to the same assignee as the present invention and herein incorporated by reference. The light source of Bergman et al. contains a xenon gas which provides for the instantaneous light needed for automotive applications along with mercury and metal halide ingredients that provide for the high efficiency lumen output of the automotive headlamp.

In optical systems such as automotive headlamps, it is desired that the source of light be accurately located relative to the reflector of the headlamp. In automotive headlamps using discharge light sources, such as a xenon-metal halide lamp, it is desired that the arc be located between the electrodes so as to serve as a light source that is accurately located relative to the envelope comprising the light source itself. One of the means of accomplishing such locating of the arc is to accurately center the electrodes within the envelope. Various schemes to achieve electrodes centering are known. For example, the shaped foil described in U.S. Pat. No. 4,254,356 of Karikas provides the means to fit the electrodes into quartz tubing, forming a light source, and holding the electrodes on the axis of the envelope. The means of Karikas serves well the needs of lamps having a relatively long distance or arc gap between electrodes. However, for lamps with short arc gaps, such as between 1.5 to 3 mm as for xenon-metal halide lamps used for automotive applications, the shaped foil of Karikas does not provide sufficiently accurate and repeatable centering of the electrodes. Furthermore, for low wattage lamps, the bulb size should be very small in order to obtain high efficiency. To obtain consistent performance, that is color and efficiency, from lamp to lamp it is necessary that the electrodes be accurately positioned on the axis of the lamp. It is desired that means be provided to more accurately allow centering of the electrodes to be accomplished so that the optical position of the light generated by the xenon-metal halide may be more precisely known.

A further consideration related to the electrodes of the xenon-metal halide lamp is the different amounts of current the electrodes must carry during the various phases of operation of the xenon-metal halide lamp. The various phases of a xenon-metal halide lamp, as somewhat described in U.S. patent application Ser. No. 157,436, may be considered as; (1) the initial starting phase in which light is produced by the excitation of the xenon gas which requires a relatively high current to produce sufficient power because the voltage drop through the lamp is relatively low (15V) to form an electron emitting spot to be created on the electrode at a low voltage (2) the phase of mercury vaporization with increase in voltage drop and the warming up of the electrodes to a full thermionic state, and (3) the final or run phase of operation in which the vaporization and excitation of the metal halides in addition to the emission of the mercury supplies the steady state light output of the lamp.

In order to obtain an efficient light output during warm-up of the high pressure xenon-metal halide lamp, which includes initial and intermediate phases of lamp operation, a current several times higher than the normal or run current is commonly desired. This heavy current requires that an electrode have dimensions that are much heavier than would be required if only the lower run current was needed. The heavy dimensions are required so that the electrode has sufficient current carrying capabilities so as to not melt or vaporize during the warm-up phase of lamp operation. This same electrode must, however, run sufficiently hot so as to maintain thermionic emission and thereby operate stably during the steady state operation which occurs at a much lower current. It is desired that the electrodes have parameters that accommodate the various current needs related to the operation of the xenon-metal halide lamp.

Accordingly, it is an object of the present invention to provide an electrode structure that is adapted to the different amounts of current occurring during the various phases of operating the high pressure xenon-metal halide lamp.

It is a further object of the present invention to provide means for accurately centering the electrodes of the xenon-metal halide lamp.

SUMMARY OF THE INVENTION

The present invention is directed to a xenon-metal halide discharge light source having an improved electrode structure which is particularly suited for a headlamp for automotive applications.

In one embodiment the light source comprises an envelope with a pair of opposite neck portions each with a coaxial central opening having a reduced section of predetermined inside diameter and length. The envelope contains a fill comprising a high pressure xenon gas, a mercury metal in a prescribed amount and a prescribed amount of a mixture of metal halides. The light source further comprises a pair of electrodes each having a predetermined length respectively positioned at opposite neck portions and separated from each other by a predetermined distance. The electrodes each consist of a shank portion and a tip portion which has a diameter that is substantially larger than that of the shank portion. The shank portion has a coil wrapped around its portion which is in contact with the inner surface of the coaxial openings of the respective neck portion. The wrapped coil in cooperation with the reduced sections cause the electrodes to be axially aligned within the envelope within a prescribed range.

In another embodiment, the light source of the present invention is lodged within an automotive headlamp comprising a reflector to which is mated connector means capable of being connected to an excitation source of an automobile. The reflector has a predetermined focal length and a focal point and a lens member which is mated to its front section. The light source is predeterminedly positioned within the reflector so as to be approximately disposed near the focal point of the reflector. The light source is connected to the connector means so that an excitation source is capable of being applied across the electrodes, whereby upon such application; (1) a discharge is established which begins to heat the electrodes to a state of their thermionic emission while at the same time the xenon is excited to produce light and (2) the mercury and metal halide are then vaporized to produce light.

DETAILED DESCRIPTION OF THE PREFERRED EMBODIMENTS

Figure 1:
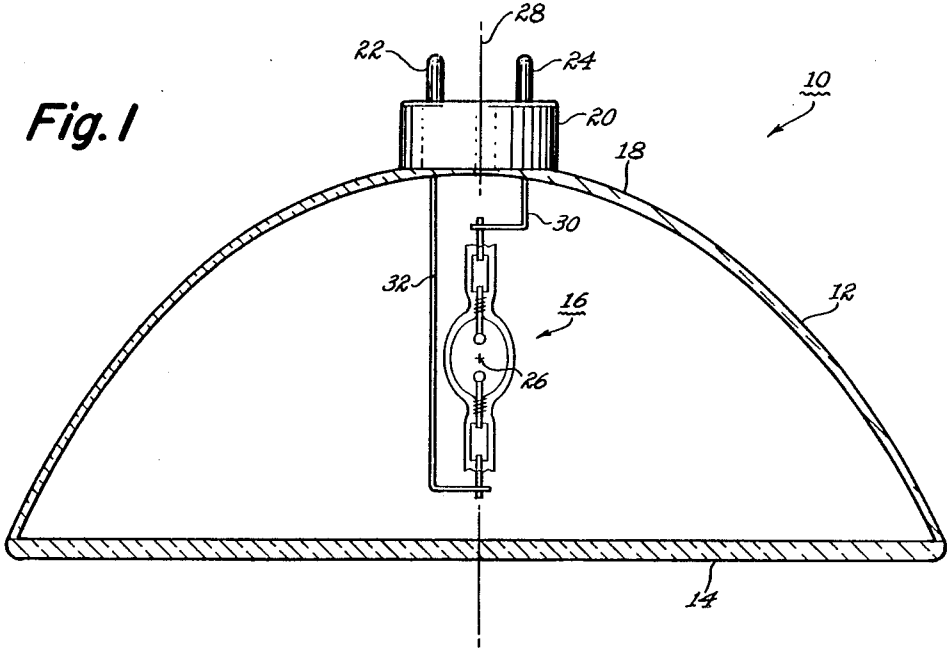
FIG. 1 is a top view generally illustrating an automotive headlamp in accordance with the present invention having a metal-halide light source oriented in a horizontal axially manner.

FIG. 1 is a top view generally illustrating an automotive lamp 10 in accordance with one embodiment of the present invention comprising a reflector 12, a lens member 14 and an inner envelope 16 serving as a light source for the lamp 10.

The reflector 12 has provisions for mounting the inner envelope and a rear section 18 having means mounted thereon, such as a connector 20, with prongs 22 and 24 capable of being connected to suitable power excitation source of an automobile.

The reflector 12 has a predetermined focal length 26 occurring along the axis 28 of the automotive headlamp 10. The light source 16 is preferably oriented, in a horizontal manner relative to and along the axis 28 of the reflector 12, by means of structural members 30 and 32 so that its mid-portion is approximately disposed near the focal length 26 of the reflector 12. The reflector 12 has a parabolic shape with a focal length in the range of about 6 mm to about 35 mm with a preferred range of about 8 mm to about 25 mm. The lens member 14 is mated to the front section of the reflector 12. The lens 14 is of a transparent material selected from the group consisting of glass and plastic and has a face portion which is preferably formed of prism members (not shown).

Figure 2:
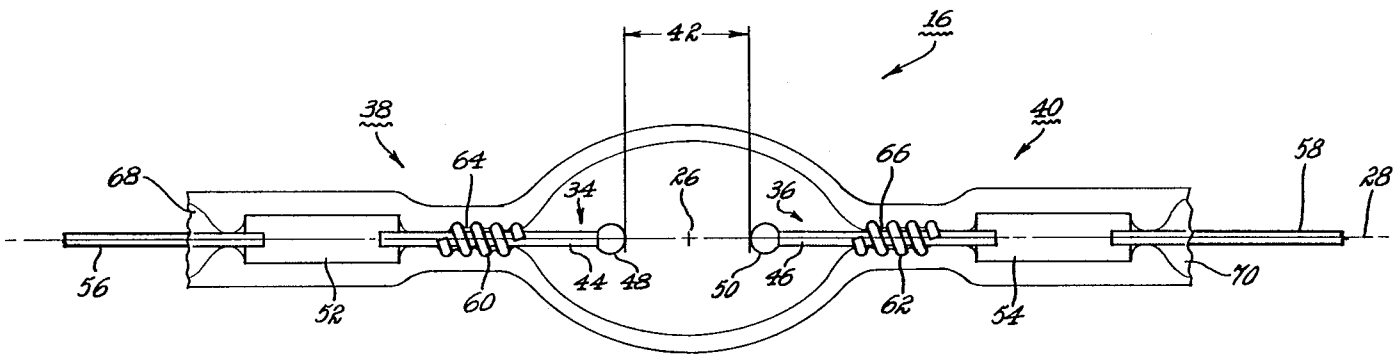
FIG. 2 illustrates the metal halide light source shown in FIG. 1.

The light source of lamp 10 is shown in more detail in FIG. 2 as being a double ended type having a pair of electrodes 34 and 36 disposed at opposite ends of neck sections 38 and 40 of the light source. The electrodes are separated from each other by a predetermined distance 42 preferably in the range of about 1 mm to about 8 mm. The light source 16 is of an elongated body having an overall length in the range of about 15 mm to about 40 mm, neck portions with a diameter in the range of about 1 mm to about 5 mm, and a bulbous shape central portion having a mid portion with a diameter in the range of about 3 mm to about 15 mm.

The light source 16 contains ingredients which are quite similar to those in the fill described in the previously mentioned U.S. patent application Ser. No. 157,436 and are comprised of xenon, mercury and metal halides. The xenon gas has a fill pressure at room temperature in the range of about 2 atmospheres to about 15 atmospheres. The mercury contained in the xenon-metal halide lamp 16 is in an amount in the range of about 0.5 mg to about 10 mg. The amount of mercury is chosen so that with an envelope of a certain size and a distance between the electrodes of a certain amount, the voltage drop across the light source is a convenient value so that the convection currents within the light source that produce bowing of the arc do not cause excessive bowing. The operating pressure which is a result of both the xenon and the mercury is in the range of about 3 to 100 atmospheres. The metal halide is present in the amount in the range of about 0.4 mg to about 12 mg. The mixture is comprised of halides selected from the group given in Table 1.

TABLE 1

| | |
|---|---|
| Sodium Iodide | Holmium Iodine |
| Scandium Iodide | Thulium Iodine |
| Thallium Iodine | Thorium Iodide |
| Indium Iodine | Cadmium Iodide |
| Tin Iodine | Cesium Iodide |
| Dysprosium Iodine | |

The xenon-metal halide lamp 16 of the present invention is particularly suited to serve as a light source for automotive forward lighting applications. The xenon-metal halide lamp has an electrode structure which is of particular importance to the present invention. The electrodes 34 and 36 respectively consist of shank portions 44 and 46 and tip portions 48 and 50 each with a diameter which is substantially larger than that of the shank portion. For D.C. operation, that is where the excitation applied to the electrodes is of a substantially constant value and flowing in one direction only, one of the electrodes, for example the cathode, need not be of a ball shape but rather may be pointed. In the embodiment shown in FIGS. 2 and 1 related to an inner envelope 16 of a quartz material, the shank portions 44 and 46 are respectively connected to one end of foil members 52 and 54 sealed in opposite neck portions. The foil members 52 and 54 have their other end respectively connected to relatively thick outer leads 56 and 58, which, in turn, are respectively connected to the structural members 32 and 30 shown in FIG. 1. In another embodiment related to the inner envelope preferably of a type #180 glass available from the General Electric Company, the shank portions 44 and 46 may be welded to molybdenum inleads 56 and 58, respectively, which, in turn, may be directly sealed in #180 glass thereby eliminating the need of the foil members 52 and 54. The shank portions 44 and 46 respectively have wrapped there around coil members 60 and 62. For the embodiment shown in FIGS. 1 and 2, the electrodes 34 and 36 along with coil members have typical parameters given in Table 2.

TABLE 2

| ELECTRODES PORTIONS | MATERIAL | SHAPE/TYPE | RANGE OF LENGTH in mm | RANGE OF DIAMETER in mm |
|---|---|---|---|---|
| Shank (44 & 46) | Tungsten or Tungsten with 1% to 3% thorium oxide | Rod | 2.0 to 10.0 | 0.127 to 1.0 |
| Tip (48 & 50) | Tunsten or Tunsten with 1% + 3% thorium oxide | Ball, cylindrical, cone, slotted cylindrical or slotted cone | — | 0.20 to 1.27 |
| Coils (60 & 62) | Tungsten Wire | Wire<br>Primary Mandrel<br>Secondary Mandrel | — | 0.025 to 0.102<br>0.076 to 0.203<br>0.51 to 1.27 |

The coils 60 and 62 are respectively slipped over a portion of shanks 44 and 46 which is in contact with the inner surface of reduced sections 64 and 66 of coaxial central openings 68 and 78. In one embodiment, the coils 60 and 62 are of a coiled-coil type and are slipped over about 3 mm of the length of the shanks which are in contact with sections 64 and 66. A coiled-coil is preferred because it is soft, that is compliant, which allows it to squeeze into the opening in the neck. The result is that the fit between the neck and the coil does not have to be exact in order to obtain excellent centering action. The coil contacts the shank and the reduced sections for a sufficient distance so that electrodes are forced to be aligned to the center axis of the light source within about 0.5 mm. The alignment of the electrodes to the center axis of the light source, which, in turn, is located at the center axis 28 of the lamp 10 is of particular importance to the present invention. The contacting or wrapping of the length of the coil is dependent upon the length of the electrodes which, in turn, controls the length of the reduced sections.

In order for the coil wrapped around the shank to provide centering of the electrodes, the central openings holes 68 and 70 forming part of the initial fabrication of light source 16, need to be of a close dimension to the outer diameter of the wrapping coil and these central openings also need to be closely centered to the axis of the light source.

The neck portion of the bulb may be formed by first having the coiled wire wrapped around a mandrel that is selected having a diameter which is substantially equal to that of the coil on the shank of the electrode. The mandrel is then inserted into the bulb and the neck portions are heated and caused to shrink onto the mandrel due to surface tension of the bulb material. It is desired that during such formation that means be provided to prevent the tungsten from oxidizing. Such means may be in the form of an inert gas that is flushed through the inner envelope to displace air during the formation of the neck portions of the bulb.

When the quartz material preferably forming the envelope and the tungsten preferably forming the mandrel cool, the tungsten pulls away from the quartz because of a large difference in the respective coefficients of expansion. The mandrel may then be pulled from the quartz tubing leaving behind a precisely formed neck region of the envelope 16.

During the assembly of the light source 16, the coil on the shank of the electrode is snugly housed within the neck of the envelope by means of a shrinking process. To assist in shrinking the neck portion of the envelope unto the coiled filament, the pressure inside the envelope may be reduced so that when the neck portion of the envelope is heated, the pressure of the atmosphere assists in causing the neck portion of the envelope to shrink down onto the coil on the shank of the electrode.

In addition to its alignment function, the coil on the shank of the electrode provides another function during the operation of the light source 16 in that it keeps the hot electrodes from intimate contact with the envelope, which, in turn, reduces the heat transferred to the envelope which is important in keeping the mercury and the metal halides from condensing in the neck region of the envelope. Such condensation would otherwise prevent the contribution of these ingredients to the arc condition of the lamp. The coil on the shank of the electrode also prevents any possible thermal expansion of the electrodes from cracking the lamp envelope. Further, the coiled filament prevents the quartz material of the envelope from bonding to the surface of the shank of the electrode which may otherwise result in cracking of the envelope when these electrodes cool and contract after operation and when they are sealed in the neck regions of the light source.

In a manner similar to that as disclosed in U.S. patent application Ser. No. 157,436, the initial application of an excitation source across the electrodes 34 and 36 of the metal xenon metal halide lamp 16 of the present invention causes; (1) the initial starting phase in which light is produced by the excitation of the xenon gas which requires a relatively high current to produce sufficient power because the voltage drop through the lamp is relatively low (15V) to form an electron emitting spot tube created on the electrode at a low voltage (2) the phase of mercury vaporization with increase in voltage drop and the warming-up of the electrodes to a full thermionic state, and (3) the final or run phase of operation in which the vaporization and excitation of the metal halides in addition to the emission of the mercury supplies the steady state light output of the lamp.

The emission of electrons during the start phase is hereinafter referred to as the "spot mode" and is more fully described in U.S. Pat. No. 4,574,219 of Davenport et al., assigned to the same assignee as the present invention, and herein incorporated by reference. In addition, during the initial starting phase the xenon gas is made electrically conductive and the electrodes are forced into a low voltage arc state on the relatively cold electrodes. Further, during the starting phase the xenon is excited at elevated currents to produce light, and the heat generated by such currents in the electrode is dissipated substantially by the tip portion of the electrode by means of radiation and conduction. In the run phase, the current is reduced to a lower value and the related heat is dissipated substantially by the shank portion of the electrode. The xenon ingredient of the light source 16 operates to supply sufficient instant light for automotive applications, whereas, the mercury and the metal halide ingredients operate to provide a long life higher efficient headlamp for the automotive applications.

When the xenon metal halide lamp is energized in a cool condition, the mercury in the light source is mostly condensed as are the metal halides, and the lamp is essentially operating as a high pressure xenon lamp. During such initial conditions, high intensity light spots are located in front of the electrodes which provide regions of high brightness. As the xenon metal halide lamp 16 warms up, the xenon emission is gradually augmented by the mercury and the metal halide emissions. As the voltage across the light source begins to rise and the current delivered to the light source begins to drop, the relative amount of electrode loss to the total power of the light source decreases which correspondingly causes the efficacy of the light source to increase.

The thermal characteristics of electrodes 34 and 36 of the present invention are selected to be particularly suited to accommodate the operations of the xenon-metal halide lamp 16. The thermal characteristics of the electrodes, some of which are given in Tables 2 and 3, are primarily controlled by; (1) the size of the tip; (2) the diameter and length of the shank portion; (3) and the thermal characteristics of the coil on the shank of the electrodes. As discussed in the "Background" section, the electrodes need to be provided with a sufficient current carrying capability so as not to melt or vaporize excessively during the initial high current needed to start the xenon-metal halide lamp and provide the instant light, while at the same time, the electrodes need to be able to accommodate the stable run steady state operation of the lamp which occurs at a much lower current than that of starting. The various phases of the operation of light source 16 along with related electrode parameters are given in Table 3.

TABLE 3

| PHASES OF LAMP OPERATION | RELATED CURRENT | ELECTRODE MAIN CONTRIBUTOR AND RELATED TEMP |
|---|---|---|
| Initial electrode spot mode and xenon excitation | 3.5–4.0A for about 2.5 seconds | Tip less than 3600° K. |
| Mercury and Metal Halide Vaporization | Programmed down to 0.6A | Steady State Spot on Tip approximately 2400° K.–2600° K. |

It should be noted and as we have discovered, the amount of current necessary for initiating the spot mode and heating up the electrodes to thermionic emission is less than that needed to maintain the light output during the initial xenon excitation phase which is critical to the proper functioning of the light source to produce instant light. From this function we have discovered that we can therefore start the electrode by going directly to the arc or spot mode and do not need to supply a large area of the electrode to establish glow current start. The elimination of the glow current means the related ballast circuit does not need to have an associated low current high voltage condition capability which reduces the cost of the ballast itself. The ballast circuit need only supply the maximum current desired for the xenon excitation and also the reduced current desired for the run condition of the xenon-metal halide lamp.

The electrode of the present invention needs to have a thermal design that does not allow the electrode to melt or vaporize excessively during high current start related to the "spot mode" and to the xenon excitation, and then the same electrode needs to run or operate with a stable spot during steady state operation at a much lower current. To achieve this dual function for the electrode, we have discovered that over the range of interest we can design the electrode so that the thermal properties for the high current start can be achieved by means of radiation loss from a large area ball on the tip with a temperature raised to the fourth power dependence of removing energy per unit area, that makes the radiation loss from the ball more dominant the higher the ball temperature relative to the conduction loss down the shank which conducts energy proportional to the first power of temperature. At the lower operating current, the electrode is cooler and the energy loss from the ball is now governed primarily by heat conduction down the shank which is proportional to the first power of this lower ball temperature. This large area balled tip can be any convenient shape to serve as a thermal radiator. We have chosen a balled shank electrode because of the ease of manufacturing this shape from tungsten. Tips of other shapes, for example, cylinders, cones, slotted cylinders or cones, etc., will serve as viable electrode shapes for our lamp as long as they have the proper area and emissivity to radiate the energy of the starting mode. Therefore, the higher the ball temperature the more important the ball or tip becomes in removing the energy so that with the proper choice of ball diameter most of the input energy to the electrode during the start can be radiated away at a ball temperature below the melting point of tungsten. Furthermore, the proper operating temperature for the lower steady state current is controlled primarily by the diameter and length of the electrode shank.

In operation, the electrodes of the present invention are dimensioned such that at the current required to produce a sufficient light from the xenon emission, the ball operates in the range of 2300° K. to 3600° K. in the initial electrode thermionic emission phase and then drops to an average ball temperature of about 2300° K.–2600° K. when the electrode reaches a steady state at the current necessary for the metal halide radiation period. For one embodiment, a typical starting current of 3.5 amperes was applied to the electrodes of the present invention and gradually reduced to about 1.0 ampere in 3.0 seconds and then in about 17 seconds to a constant power condition of 25 watts achievable by a steady state or run current of 0.6A RMS. To accommodate these starting and run conditions, a tip size of 0.61 mm in diameter located at the end of a 0.35 mm diameter of a wire serving as the shank was selected. The shank had a length of about 5.0 mm on which was wrapped a coiled-coil for about 2.5 mm formed from a 0.076 mm diameter tungsten wire. The coiled-coil, in turn, was formed by first being coiled around a 0.229 mm mandrel, which, in turn was then coiled around a 0.305 mm secondary mandrel. The mandrels were dissolved from the coiled-coil before placing it on the shank of the electrode. During such operation, the electrodes produced a ball temperature of less than 3680° K.

which eventually lowered to a hot spot arc terminus temperature of 2600° K. and an average ball temperature of 2300° K.

It should now be appreciated that the practice of the present invention provides an electrode structure that is particularly suited for the operational conditions of xenon-metal halide automotive headlamp. Further, it should be appreciated that means are provided to accurately locate the electrodes along the axis of the light source, which, in turn, allows the light being generated by the light source to be accurately located relative to the axis of the automotive headlamp.

What we claim as new and desire to secure by Letters Patent of the United States is:

1. A light source comprising:

(A) an envelope having a pair of opposite neck portions each with a coaxial central opening having a reduced section and containing a fill comprising;

($A_1$) a xenon pressure at room temperature at a range of about 2 atmospheres to about 15 atmospheres;

($A_{11}$) mercury in the an amount in the range of about 0.5 mg to about 10 mg; and ($A_{111}$) a mixture of an amount in the range of about 0.4 mg to about 12 mg, said mixture selected from the group consisting of sodium iodine, scandium iodine, thallium iodine, indium iodine, tin iodine, dysprosium iodine, holmium iodide, thulium iodide, thorium iodide, cadmium iodide, scandium iodide; and (B) a pair of electrodes respectively positioned at said opposite neck portions and separated from each other by a predetermined distance, said electrodes consisting of a shank portion and a tip portion having a diameter which is substantially larger than the shank portion, said shank portion having a coil wrapped around its portion which is in contact with the inner surface of the reduced section of the coaxial openings, said coil contacting said reduced section causing the electrode to be axially aligned within said inner envelope.

2. A light source according to claim 1 wherein said tip portion has a shape selected from the group consisting of a ball, cylindrical, cone, slotted cylindrical and slotted cone.

3. A light source according to claim 1 wherein said electrodes are comprised of a material selected from the group consisting of tungsten and tungsten with one percent to 3 percent thorium oxide.

4. A light source according to claim 2 wherein; (1) said tip is of a ball shape having a diameter of from about 0.20 mm to about 1.27 mm; (2) said shank having a diameter of about 0.127 mm to about 1.0 mm and a length of about 2 mm to about 10 mm, and (3) said coil is a coiled-coil filament formed of a tungsten wire having a diameter of about 0.076 mm.

5. A light source according to claim 1 wherein said electrodes are separated from each other by a distance from about 1 mm to about 8 mm.

6. An automotive headlamp comprising:

(A) reflector having a predetermined focal length and focal point and provisions for mounting an inner envelope and means to connect the inner envelope to a suitable power source of an automobile, (B) a lens member mated to a front section of said reflector; and (C) said inner envelope being predeterminedly positioned within said reflector so as to be approximately disposed near said focal point of said reflector, said inner envelope containing a fill of xenon at a relatively high pressure along with mercury and metal halide ingredients, said inner envelope having a pair of opposite neck portions each with a coaxial central opening having a reduced section, said inner envelope having a pair of electrodes respectively positioned at said opposite neck portions and separated from each other by a predetermined distance, said electrodes comprising of a shank portion and a tip portion having a diameter which is substantially larger than that of the shank portion, said shank portion having a coil wrapped around its portion which is in contact with the inner surface of said reduced sections of said coaxial openings of said respective neck portion, said inner envelope being connected to said means mated to said sections so that said excitation source is capable of being applied across said electrodes, whereby upon such application; (1) a discharge is established which begins to heat the electrodes to a state of their thermionic emission while at the same time the xenon is excited to produce light, and (2) the mercury and metal halide are vaporized to produce light.

7. An electrode for a gas discharge lamp which lamp is comprised of an envelope having a pressurized fill and including opposite neck portions each with a coaxial central opening having reduced sections with inner surfaces, said electrode being located in each of said neck portion and separated from each other by a predetermined distance, said electrode comprising; a shank portion and a tip portion having a diameter which is substantially larger than that of the shank portion, said shank portion having a coil wrapped around its portion which is in contact with the inner surface of the reduced section of the respective neck portions, said coil contacting said reduced section causing the electrodes to be axially aligned within said inner envelope.

* * * * *